United States Patent [19]

Zelazny

[11] 4,179,128

[45] Dec. 18, 1979

[54] CONSTRUCTION BOARD GAME

[76] Inventor: David M. Zelazny, 7803 Stanelan, Detroit, Mich. 48228

[21] Appl. No.: 836,487

[22] Filed: Sep. 26, 1977

[51] Int. Cl.[2] ..... A63F 3/00

[52] U.S. Cl. ..... 273/243; 273/256

[58] Field of Search ..... 273/236, 243, 256, 257, 273/279, 245

[56] References Cited

U.S. PATENT DOCUMENTS

| | | | |
|---|---|---|---|
| 3,826,498 | 7/1974 | Monek | 273/245 |
| 4,085,938 | 4/1978 | Bean, Jr. | 273/279 |
| 4,093,233 | 6/1978 | Barbarow | 273/245 |

FOREIGN PATENT DOCUMENTS

| | | | |
|---|---|---|---|
| 611043 | 10/1948 | United Kingdom | 273/243 |
| 801964 | 9/1958 | United Kingdom | 273/243 |

*Primary Examiner*—Richard C. Pinkham
*Assistant Examiner*—R. Carl Moy
*Attorney, Agent, or Firm*—Basile and Weintraub

[57] ABSTRACT

A game wherein each participant is supplied with simulated currency which the player uses to simulate the activities generally associated with the construction industry, such that the participants develop an understanding of the decision making and financial aspects of the construction industry. The game consists of a playing board having a peripheral area marked with spaces that constitute a plurality of individual playing courses, each course being representative of the various steps associated with a construction project, such as constructing a building. Each course is provided with a plurality of instructions which, by the throw of dice by the participant determines his profit and loss during each step of the course.

5 Claims, 10 Drawing Figures

CONSTRUCTION BOARD GAME

BACKGROUND OF THE INVENTION

I. Field of the Invention

The present application relates to the art of recreational devices and, in particular, the present invention seeks to provide a game board apparatus intended to familiarize participants with certain broad principles of business and finance applicable to the construction industry, while affording entertainment and intellectual challenge in the simulated financing of a building project.

II. Description of the Prior Art

While there are many educational games which teach various aspects, such as geographical information, games adapted to familiarize participants with broad legal principles in the acquisition of property, investments, and the purchasing of services and goods, the applicant is not aware of any game which familiarizes participants with the broad business and financial principles applicable to the construction industry. Further, while many previous games have provided entertainment and intellectual challenge, most such games consist of a game board with a plurality of player elements which are moved thereabout around the periphery of the board according to numbers determined by chance, such as the rolling of dice or the rotating of a spinner. Interrelationships between the players themselves are often excluded, and generally the participants are playing along the same course at the same time. These games generally do not involve any decision making steps or any competitiveness between the players aside from the result of chance; and, thus, the participant's ability to make decisions and to choose between various alternatives goes unchallenged.

The prior art games over which the game of the present invention seeks to achieve a substantial improvement and interest in mental stimulation, training and educational experience are typified by the following U.S. Pat. Nos. 2,026,082; 2,780,463; 2,693,961; and 3,367,226.

SUMMARY OF THE INVENTION

The present invention, which will be described subsequently in greater detail, comprises a game board having a plurality of individual playing courses, each of which are individually played by the participants of the game in order to teach the participants broad principles of business and finance associated with the construction industry.

It is therefore a primary object of the present invention to provide a new and improved game involving the simulated construction of a building including the familiarization by the participants of the financial and business principles related to the construction industry.

Another object of the present invention is to provide a game in which skills in analysis, understanding of financial matters, the ability to plan in advance, and simulation of the actual construction industry are provided.

Other objects, advantages and applications of the present invention will become apparent to those skilled in the art of educational games when the accompanying description of one example of the best mode of practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
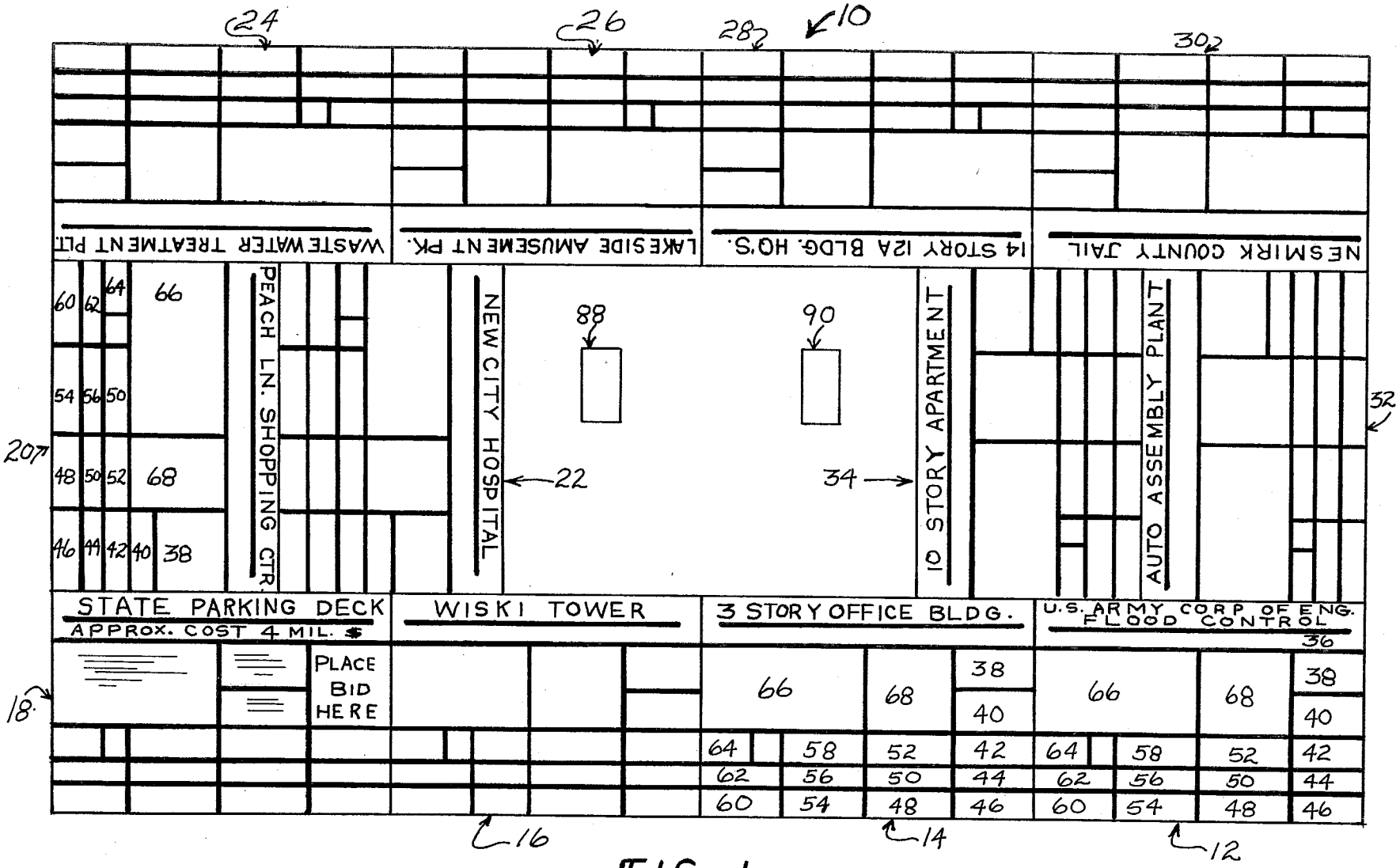
FIG. 1 is a plan view of a game board, at an appreciably reduced scale, employed in the described embodiment of the present invention and illustrating twelve separate playing courses.

Referring now to the drawings and, in particular, to FIG. 1 wherein there is illustrated one example of the present invention in the form of a game board 10. Illustrated on the board is a group of twleve individual playing courses, each of which will be described in greater detail hereinafter. Each of the playing courses represents a particular type of construction project; and as can best be seen in FIG. 2, wherein the course 18 is illustrated in an enlarged fashion, each course is divided into a plurality of sections or spaces. The upper section or spaces 36 state the name of the building project and its approximate cost of construction. Space 38 represents that portion on the course wherein each participant places his bid, a function of which will be described hereinafter. Space 40 represents the starting point in each individual course. As will be described in greater detail hereinafter, each participant, when playing a course, commences at the starting space 40 and moves through each of the numbered spaces 42 through 62, performing the designated state of construction as is associated with the actual construction of a building. For example, on space 42 excavation of the property must be performed, and a particular dollar value is noted in the space 42 so associated with the excavation of this particular course. The next space 44 designates the concrete portion and a dollar amount associated therewith. The next space 46 designates the masonry work and the dollar amount associated therewith. The next space 48 designates the steel and miscellaneous iron associated with the steel work and the dollar amount associated with such steel work. The next space 50 designates carpentry work and the dollar amount associated with such work. The next space 52 represents hollow metal and the dollar amount associated therewith. The next space 54 represents specialties and the dollar amount associated therewith. The next space 56 represents plaster work and lath and the dollar amount associated therewith. The next space 58 represents the work performed in the installation of doors, windows, and glass and the dollar amount associated therewith. The next space 60 represents mechanical matters and the dollar amount associated with the installation of such matters. The next space 62 relates to electrical matters and the dollar amount associated therewith.

Space 64 designates the end of playing for that particular course and is defined as "collect retainage" wherein the participant performs certain acts as described hereinafter. Space 66 illustrates the bidding costs associated with various types of bids in which the participants may make, and space 68 immediately to the right of space 66 is a retainage which the player receives in accordance with the type of bid he makes. This will also be described in greater detail hereinafter.

Figure 2:
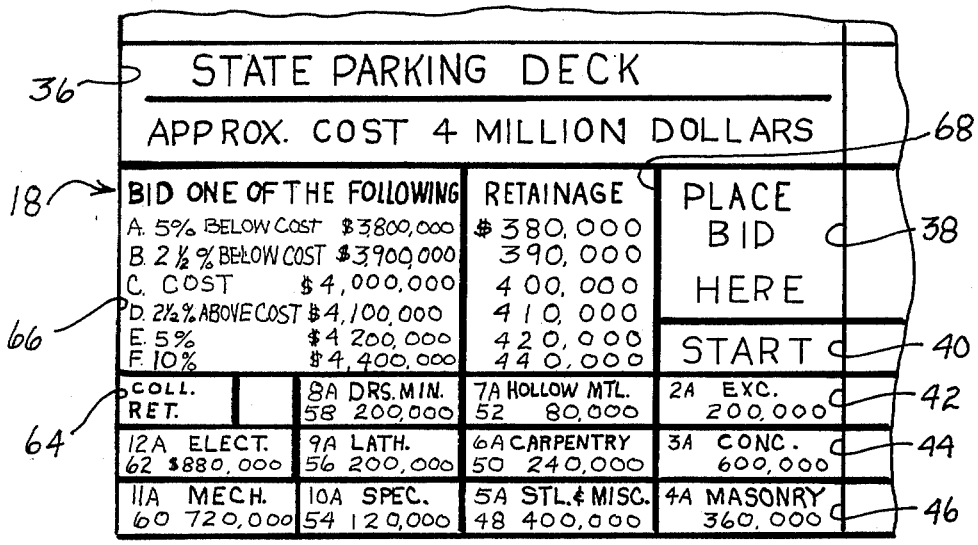
FIG. 2 is a somewhat enlarged plan view of one example of one of a plurality of individual playing courses illustrated on the game board of FIG. 1.
Figure 5:
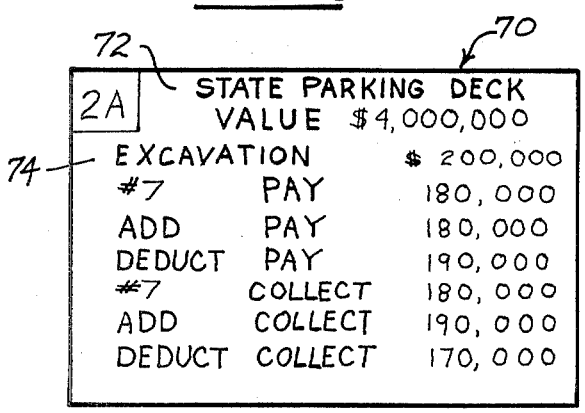
FIG. 5 is one example of a card in a set of twelve cards for each of the twelve courses and indicates certain values associated with various phases of movement by a participant through each playing course.

Referring now to FIG. 1, in addition to the indicia illustrated in FIG. 2 of the drawings with respect to the course 18, the board as aforementioned has a total of twelve courses 12 through 34. Each course has spaces 38 and 40 which designate the positioning spot for the bids and the starting position for the individual course, respectively. Additionally, each space 42 through 62 designates the aforementioned sub-construction portions of the construction of a building or similar project; that is, the spaces 42 through 62 designate respectively the cost for excavation; concrete; masonry; steel & miscellaneous iron; carpentry; hollow metal; doors; windows, glass; lath & plaster; specialties; mechanical work; and electrical work. Similarly, each of the courses has a collect retainage space 64. The dollar amounts associated with each of the spaces 42 through 62 will be described hereinafter with respect to the plurality of job cost construction cards 70 that are illustrated in FIG. 5 of the drawings.

As can best be seen in FIGS. 1 and 2 of the drawings, each of the courses 12 through 34 contains the spaces 66 and 68 respectively indicating the amount at which a party may bid and the retainage that a participant receives if he bids that amount and successfully completes the course for that particular building job. The various bid amounts, which are determined in the manner to be described hereinafter, and the retainage that is associated with bid amounts are as follows for each of the following courses:

1. Course 12: United States Army Corp. of Engineers Flood Retention Basin—approximate cost $6,000,000.

| BID | RETAINAGE |
|---|---|
| (a) 5% Below Cost $5,700,000 | $570,000 |
| (b) 2.5% Below Cost $5,850,000 | $585,000 |
| (c) Cost $6,000,000 | $600,000 |
| (d) 2.5% Above Cost $6,150,000 | $615,000 |
| (e) 5% Above Cost $6,300,000 | $630,000 |
| (f) 10% Above Cost $6,600,000 | $660,000 |

2. Course 14: 3 Story Office Building—approximate cost $6,000,000.

| BID | RETAINAGE |
|---|---|
| (a) 5% Below Cost $5,700,000 | $570,000 |
| (b) 2.5% Below Cost $5,850,000 | $585,000 |
| (c) Cost $6,000,000 | $600,000 |
| (d) 2.5% Above Cost $6,150,000 | $615,000 |
| (e) 5% Above Cost $6,300,000 | $630,000 |
| (f) 10% Above Cost $6,600,000 | $660,000 |

3. Course 16: WSKI Tower—approximate cost $4,000,000.

| BID | RETAINAGE |
|---|---|
| (a) 5% Below Cost $3,800,000 | $380,000 |
| (b) 2.5% Below Cost $3,900,000 | $390,000 |
| (c) Cost $4,000,000 | $400,000 |
| (d) 2.5% Above Cost $4,100,000 | $410,000 |
| (e) 5% Above Cost $4,200,000 | $420,000 |
| (f) 10% Above Cost $4,400,000 | $440,000 |

4. Course 18: State Parking Deck—approximate cost $4,000,000.

| BID | RETAINAGE |
|---|---|
| (a) 5% Below Cost $3,800,000 | $380,000 |
| (b) 2.5% Below Cost $3,900,000 | $390,000 |
| (c) Cost $4,000,000 | $400,000 |
| (d) 2.5% Above Cost $4,100,000 | $410,000 |
| (e) 5% Above Cost $4,200,000 | $420,000 |
| (f) 10% Above Cost $4,400,000 | $440,000 |

5. Course 20: Peach Lane Shopping Center—approximate cost $20,000,000.

| BID | RETAINAGE |
|---|---|
| (a) 5% Below Cost $19,000,000 | $1,900,000 |
| (b) 2.5% Below Cost $19,500,000 | $1,950,000 |
| (c) Cost $20,000,000 | $2,000,000 |
| (d) 2.5% Above Cost $20,500,000 | $2,050,000 |
| (e) 5% Above Cost $21,000,000 | $2,100,000 |
| (f) 10% Above Cost $22,000,000 | $2,200,000 |

6. Course 22: New City Hospital—approximate cost $22,000,000.

| BID | RETAINAGE |
|---|---|
| (a) 5% Below Cost $20,900,000 | $2,090,000 |
| (b) 2.5% Below Cost $21,450,000 | $2,145,000 |
| (c) Cost $22,000,000 | $2,200,000 |
| (d) 2.5% Above Cost $22,550,000 | $2,255,000 |
| (e) 5% Above Cost $23,100,000 | $2,310,000 |
| (f) 10% Above Cost $24,200,000 | $2,420,000 |

7. Course 24: Wastewater Treatment Plant—approximate cost $18,000,000.

| BID | RETAINAGE |
|---|---|
| (a) 5% Below Cost $17,100,000 | $1,710,000 |
| (b) 2.5% Below Cost $17,550,000 | $1,755,000 |
| (c) Cost $18,000,000 | $1,800,000 |
| (d) 2.5% Above Cost $18,450,000 | $1,845,000 |
| (e) 5% Above Cost $18,900,000 | $1,890,000 |
| (f) 10% Above Cost $19,800,000 | $1,980,000 |

8. Course 26: Lakeside Amusement Park—approximate cost $16,000,000.

| BID | RETAINAGE |
|---|---|
| (a) 5% Below Cost $15,200,000 | $1,520,000 |
| (b) 2.5% Below Cost $15,600,000 | $1,560,000 |
| (c) Cost $16,000,000 | $1,600,000 |
| (d) 2.5% Above Cost $16,400,000 | $1,640,000 |
| (e) 5% Above Cost $16,800,000 | $1,680,000 |
| (f) 10% Above Cost $17,600,000 | $1,760,000 |

9. Course 28: 14 Story IZA Building Headquarters—approximate cost $14,000,000.

| BID | RETAINAGE |
|---|---|
| (a) 5% Below Cost $13,300,000 | $1,330,000 |
| (b) 2.5% Below Cost $13,650,000 | $1,365,000 |
| (c) Cost $14,000,000 | $1,400,000 |
| (d) 2.5% Above Cost $14,350,000 | $1,435,000 |
| (e) 5% Above Cost $14,700,000 | $1,470,000 |
| (f) 10% Above Cost $15,400,000 | $1,540,000 |

10. Course 30: Nesmrik County Jail—approximate cost $12,000,000.

| BID | RETAINAGE |
|---|---|
| (a) 5% Below Cost $11,400,000 | $1,140,000 |
| (b) 2.5% Below Cost $11,700,000 | $1,170,000 |
| (c) Cost $12,000,000 | $1,200,000 |
| (d) 2.5% Above Cost $12,300,000 | $1,230,000 |
| (e) 5% Above Cost $12,600,000 | $1,260,000 |
| (f) 10% Above Cost $13,200,000 | $1,320,000 |

11. Course 32: Automotive Assembly Plant—approximate cost $8,000,000.

| BID | RETAINAGE |
|---|---|
| (a) 5% Below Cost $7,600,000 | $760,000 |
| (b) 2.5% Below Cost $7,800,000 | $780,000 |
| (c) Cost $8,000,000 | $800,000 |
| (d) 2.5% Above Cost $8,200,000 | $820,000 |
| (e) 5% Above Cost $8,400,000 | $840,000 |
| (f) 10% Above Cost $8,800,000 | $880,000 |

12. Course 34: 10 Story Apartment—approximate cost $8,000,000.

| BID | RETAINAGE |
|---|---|
| (a) 5% Below Cost $7,600,000 | $760,000 |
| (b) 2.5% Below Cost $7,800,000 | $780,000 |
| (c) Cost $8,000,000 | $800,000 |
| (d) 2.5% Above Cost $8,200,000 | $820,000 |
| (e) 5% Above Cost $8,400,000 | $840,000 |
| (f) 10% Above Cost $8,800,000 | $880,000 |

Associated with each course 12 through 34 is a set of cost information cards 70. Each set includes eleven cards numbered 2A through 12A, which corresponds to the numbers 2A through 12A in the spaces 42 through 62 of FIG. 2. The card 70 illustrated in FIG. 2 is typical of the cards of each set. Each card has a designation 72 at the top which names the particular project and its total value. A sub-designation 74 designates the type of job that the participant is working on. For example, in FIG. 5 the card 2A relates to the excavation and has the same dollar amount ($200,000) as indicated in space 42 in FIG. 2. The card 70 has instructions which relate to a number which is obtained by the roll of a dice, as will be explained hereinafter. For example, if the dice is rolled so as to obtain the number 7, the pay amount, as illustrated in FIG. 5, is for $180,000. Other rolls of the dice can result in any one of several numerals which result in the determination of the amount of money that the player must theoretically receive and/or pay out in the course of performing the excavation, all of which will be described in greater detail hereinafter during the description of the game. Each course has a set of cards 70 which includes eleven cards Nos. 2A through 12A. The set of cards 70 associated with the game 12 are as follows and include the following designations:

Course 12: U.S. Army, Value $6,000,000

2A Excavation, Value $300,000; #7 Pay $270,000; Add Pay $270,000; Deduct Pay $285,000; #7 Collect $270,000; Add Collect $285,000; Deduct Collect $255,000

3A Concrete, Value $900,000; #7 Pay $810,000; Add Pay $810,000; Deduct Pay $855,000; #7 Collect $810,000; Add Collect $855,000; Deduct Collect $765,000

4A Masonry, Value $540,000; #7 Pay $486,000; Add Pay $486,000; Deduct Pay $513,000; #7 C/llect $486,000; Add Collect $513,000; Deduct Collect $459,000

5A Steel & Miscellaneous, Value $600,000; #7 Pay $540,000; Add Pay $540,000; Deduct Pay $570,000; #7 Collect $540,000; Add Collect $570,000; Deduct Collect $510,000

6A Carpentry, Value $360,000; #7 Pay $324,000; Add Pay $324,000; Deduct Pay $342,000; #7 Collect $324,000; Add Collect $342,000; Deduct Collect $306,000

7A Hollow Metal, Value $120,000; #7 Pay $108,000; Add Pay $108,000; Deduct Pay $114,000; #7 Collect $108,000; Add Collect $114,000; Deduct Collect $102,000

8A Doors, Windows, Glass, Value $300,000; #7 Pay $270,000; Add Pay $270,000; Deduct Pay 285,000; #7 Collect $270,000; Add Collect $285,000; Deduct Collect $255,000

9A Lath & Plaster, Value $300,000; #7 Pay $270,000; Add Pay $270,000; Deduct Pay $285,000; #7 Collect $270,000; Add Collect $285,000; Deduct Collect $255,000

10A Specialties, Value $180,000; #7 Pay $162,000; Add Pay $162,000; Deduct Pay $171,000; #7 Collect $162,000; Add Collect $171,000; Deduct Collect $153,000

11A Mechanical, Value $1,080,000; #7 Pay $972,000; Add Pay $972,000; Deduct Pay $1,026,000; #7 Collect $972,000; Add Collect $1,026,000; Deduct Collect $918,000

12A Electrical, Value $1,320,000; #7 Pay $1,188,000; Add Pay $1,188,000; Deduct Pay $1,254,000; #7 Collect $1,188,000; Add Collect $1,254,000; Deduct Collect $1,122,000

Course 14: 3 Story Office, Value $6,000,000

2A Excavation, Value $300,000; #7 Pay #270,000; Add Pay $270,000; Deduct Pay $285,000; #7 Collect $270,000; Add Collect $285,000; Deduct Collect $255,000

3A Concrete, Value $900,000; #7 Pay $810,000; Add Pay $810,000; Deduct Pay $855,000; #7 Collect $810,000; Add Collect $855,000; Deduct Collect $765,000

4A Masonry, Value $540,000; #7 Pay $486,000; Add Pay $486,000; Deduct Pay $513,000; #7 Collect $486,000; Add Collect $513,000; Deduct Collect $459,000

5A Steel & Miscellaneous, Value $600,000; #7 Pay $540,000; Add Pay $540,000; Deduct Pay $570,000; #7 Collect $540,000; Add Collect $570,000; Deduct Collect $510,000

6A Carpentry, Value $360,000; #7 Pay $324,000; Add Pay $324,000; Deduct Pay $342,000; #7 Collect $324,000; Add Collect $342,000; Deduct Collect $306,000

7A Hollow Metal, Value $120,000; #7 Pay $108,000; Add Pay $108,000; Deduct Pay $114,000; #7 Collect $108,000; Add Collect $114,000; Deduct Collect $102,000

8A Doors, Windows, Glass, Value $300,000; #7 Pay $270,000; Add Pay $270,000; Deduct Pay $285,000; #7 Collect $270,000; Add Collect $285,000; Deduct Collect $255,000

9A Lath & Plaster, Value $300,000; #7 Pay $270,000; Add Pay $270,000; Deduct Pay $285,000; #7 Collect $270,000; Add Collect $285,000; Deduct Collect $255,000

10A Specialties, Value $180,000; #7 Pay $162,000; Add Pay $162,000; Deduct Pay $171,000; #7 Collect $162,000; Add Collect $171,000; Deduct Collect $153,000

11A Mechanical, Value $1,080,000; #7 Pay $972,000; Add Pay $972,000; Deduct Pay $1,026,000; #7 Collect $972,000; Add Collect $1,026,000; Deduct Collect $918,000

12A Electrical, Value $1,320,000; #7 Pay $1,188,000; Add Pay $1,188,000; Deduct Pay $1,254,000; #7 Collect $1,188,000; Add Collect $1,254,000; Deduct Collect $1,122,000

Course 16: WSKI Tower, Value $4,000,000

2A Excavation, Value $200,000; #7 Pay $180,000; Add Pay $180,000; Deduct Pay $190,000; #7 Collect $180,000; Add Collect $190,000; Deduct Collect $170,000

3A Concrete, Value $600,000; #7 Pay $540,000; Add Pay $540,000; Deduct Pay $570,000; #7 Collect $540,000; Add Collect $570,000; Deduct Collect $510,000

4A Masonry, Value $360,000; #7 Pay $324,000; Add Pay $324,000; Deduct Pay $342,000; #7 Collect $324,000; Add Collect $342,000; Deduct Collect $306,000

5A Steel & Miscellaneous, Value $400,000; #7 Pay $360,000; Add Pay $360,000; Deduct Pay $380,000; #7 Collect $360,000; Add Collect $380,000; Deduct Collect $340,000

6A Carpentry, Value $240,000; #7 Pay $216,000; Add Pay $216,000; Deduct Pay $228,000; #7 Collect $216,000; Add Collect $228,000; Deduct Collect $204,000

7A Hollow Metal, Value $80,000; #7 Pay $72,000; Add Pay $72,000; Deduct Pay $76,000; #7 Collect $72,000; Add Collect $76,000; Deduct Collect $68,000

8A Doors, Windows, Glass, Value $200,000; #7 Pay $180,000; Add Pay $180,000; Deduct Pay $190,000; #7 Collect $180,000; Add Collect $190,000; Deduct Collect $170,000

9A Lath & Plaster, Value $200,000; #7 Pay $180,000; Add Pay $180,000; Deduct Pay $190,000; #7 Collect $180,000; Add Collect $190,000; Deduct Collect $170,000

10A Specialties, Value $120,000; #7 Pay $108,000; Add Pay $108,000; Deduct Pay $114,000; #7 Collect $108,000; Add Collect $114,000; Deduct Collect $102,000

11A Mechanical, Value $720,000; #7 Pay $648,000; Add Pay $648,000; Deduct Pay $684,000; #7 Collect $648,000; Add Collect $684,000; Deduct Collect $612,000

12A Electrical, Value $880,000; #7 Pay $792,000; Add Pay $792,000; Deduct Pay $836,000; #7 Collect $792,000; Add Collect $836,000; Deduct Collect $748,000

Course 18: State Parking Deck, Value $4,000,000

2A Excavation, Value $200,000; #7 Pay $180,000; Add Pay $180,000; Deduct Pay $190,000; #7 Collect $180,000; Add Collect $190,000; Deduct Collect $170,000

3A Concrete, Value $600,000; #7 Pay $540,000; Add Pay $540,000; Deduct Pay $570,000; #7 Collect $540,000; Add Collect $570,000; Deduct Collect $510,000

4A Masonry, Value $360,000; #7 Pay $324,000; Add Pay $324,000; Deduct Pay $342,000; #7 Collect $324,000; Add Collect $342,000; Deduct Collect $306,000

5A Steel & Miscellaneous, Value $400,000; #7 Pay $360,000; Add Pay $360,000; Deduct Pay $380,000; #7 Collect $360,000; Add Collect $380,000; Deduct Collect $340,000

6A Carpentry, Value $240,000; #7 Pay $216,000; Add Pay $216,000; Deduct Pay $228,000; #7 Collect $216,000; Add Collect $228,000; Deduct Collect $204,000

7A Hollow Metal, Value $80,000; #7 Pay $72,000; Add Pay $72,000; Deduct Pay $76,000; #7 Collect $72,000; Add Collect $76,000; Deduct Collect $68,000

8A Doors, Windows, Glass, Value $200,000; #7 Pay $180,000; Add Pay $180,000; Deduct Pay $190,000; #7 Collect $180,000; Add Collect $190,000; Deduct Collect $170,000

9A Lath & Plaster, Value $200,000; #7 Pay $180,000; Add Pay $180,000; Deduct Pay $190,000; #7 Collect $180,000; Add Collect $190,000; Deduct Collect $170,000

10A Specialties, Value $120,000; #7 Pay $108,000; Add Pay $108,000; Deduct Pay $114,000; #7 Collect $108,000; Add Collect $114,000; Deduct Collect $102,000

11A Mechanical, Value $720,000; #7 Pay $648,000; Add Pay $648,000; Deduct Pay $684,000; #7 Collect $648,000; Add Collect $684,000; Deduct Collect $612,000

12A Electrical, Value $880,000; #7 Pay $792,000; Add Pay $792,000; Deduct Pay $836,000; #7 Collect $792,000; Add Collect $836,000; Deduct Collect $748,000

Course 20: Peach Lane Shopping Center, Value $20,000,000

2A Excavation, Value $1,000,000; #7 Pay $900,000; Add Pay $900,000; Deduct Pay $950,000; #7 Collect $900,000; Add Collect $950,000; Deduct Collect $850,000

3A Concrete, Value $3,000,000; #7 Pay $2,700,000; Add Pay $ $2,700,000; Deduct Pay $2,850,000; #7 Collect $2,700,000; Add Collect $2,850,000; Deduct Collect $2,550,000

4A Masonry, Value $1,800,000; #7 Pay $1,620,000; Add Pay $1,620,000; Deduct Pay $1,710,000; #7 Collect $1,620,000; Add Collect $1,710,000; Deduct Collect $1,530,000

5A Steel & Miscellaneous, Value $2,000,000; #7 Pay $1,800,000; Add Pay $1,800,000; Deduct Pay $1,900,000; #7 Collect $1,800,000; Add Collect $1,900,000; Deduct Collect $1,700,000

6A Carpentry, Value $1,200,000; #7 Pay $1,080,000; Add Pay $1,080,000; Deduct Pay $1,140,000; #7 Collect 1,080,000; Add Collect $1,140,000; Deduct Collect $1,020,000

7A Hollow Metal, Value $400,000; #7 Pay $360,000; Add Pay $360,000; Deduct Pay $380,000; #7 Collect $360,000; Add Collect $380,000; Deduct Collect $340,000

8A Doors, Windows, Glass, Value $1,000,000; #7 Pay $900,000; Add Pay $900,000; Deduct Pay $950,000; #7 Collect $900,000; Add Collect $950,000; Deduct Collect $850,000

9A Lath & Plaster, Value $1,000,000; #7 Pay $900,000; Add Pay $900,000; Deduct Pay $950,000; #7 Collect $900,000; Add Collect $950,000; Deduct Collect $850,000

10A Specialties, Value $600,000; #7 Pay $540,000; Add Pay $540,000; Deduct Pay $570,000; #7 Collect $540,000; Add Collect $570,000; Deduct Collect $510,000

11A Mechanical, Value $3,600,000; #7 Pay $3,240,000; Add Pay $3,240,000; Deduct Pay $3,420,000; #7 Collect $3,240,000; Add Collect $3,420,000; Deduct Collect $3,060,000

12A Electrical, Value $4,400,000; #7 Pay $3,960,000; Add Pay $3,960,000; Deduct Pay $4,180,000; #7 Collect $3,960,000; Add Collect $4,180,000; Deduct Collect $3,740,000

Course 22: New City Hospital, Value $22,000,000

2A Excavation, Value $1,1000,000; #7 Pay $990,000; Add Pay $990,000; Deduct Pay $1,045,000; #7 Collect $990,000; Add Collect $1,045,000; Deduct Collect $935,000

3A Concrete, Value $3,300,000; #7 Pay $2,970,000; Add Pay $2,970,000; Deduct Pay $3,135,000; #7 Collect $2,970,000; Add Collect $2,970,000; Deduct Collect $2,805,000

4A Masonry, Value $1,980,000; #7 Pay $1,782,000; Add Pay $1,782,000; Deduct Pay $1,881,000; #7 Collect $1,782,000; Add Collect $1,881,000; Deduct Collect $1,683,000

5A Steel & Miscellaneous, Value $2,200,000; #7 Pay $1,980,000; Add Pay $1,980,000; Deduct Pay $2,090,000; #7 Collect $1,980,000; Add Collect $2,090,000; Deduct Collect $1,870,000

6A Carpentry, Value $1,320,000; #7 Pay $1,188,000; Add Pay $1,188,000; Deduct Pay $1,254,000; #7 Collect $1,188,000; Add Collect $1,254,000; Deduct Collect $1,122,000

7A Hollow Metal, Value $440,000; #7 Pay $396,000; Add Pay $396,000; Deduct Pay $418,000; #7 Collect $396,000; Add Collect $418,000; Deduct Collect $374,000

8A Doors, Windows, Glass, Value $1,100,000; #7 Pay $990,000; Add Pay $990,000; Deduct Pay $1,045,000; #7 Collect $990,000; Add Collect $1,045,000; Deduct Collect $935,000

9A Lath & Plaster, Value $1,100,000; #7 Pay $990,000; Add Pay 990,000; Deduct Pay $1,045,000; #7 Collect $990,000; Add Collect $1,045,000; Deduct Collect $935,000

10A Specialties, Value $660,000; #7 Pay $594,000; Add Pay $594,000; Deduct Pay $627,000; #7 Collect $594,000; Add Collect $627,000; Deduct Collect $561,000

11A Mechanical, Value $3,960,000; #7 Pay $3,564,000; Add Pay $3,564,000; Deduct Pay $3,762,000; #7 Collect $3,564,000; Add Collect $3,762,000; Deduct Collect $3,366,000

12A Electrical, Value $4,840,000; #7 Pay $4,356,000; Add Pay $4,356,000; Deduct Pay $4,598,000; #7 Collect $4,356,000; Add Collect $4,598,000; Deduct Collect $4,114,000

Course 24: Wastewater Treatment Plant, Value $18,000,000

2A Excavation, Value $900,000; #7 Pay $810,000; Add Pay $810,000; Deduct Pay $855,000; #7 Collect $810,000; Add Collect $855,000; Deduct Collect $765,000

3A Concrete, Value $2,700,000; #7 Pay $2,430,000; Add Pay $2,430,000; Deduct Pay $2,565,000; #7 Collect $2,430,000; Add Collect $2,565,000; Deduct Collect $2,295,000;

4A Masonry, Value $1,620,000; #7 Pay $1,458,000; Add Pay $1,458,000; Deduct Pay $1,539,000; #7 Collect $1,458,000; Add Collect $1,539,000; Deduct Collect $1,377,000

5A Steel & Miscellaneous, Value $1,800,000; #7 Pay $1,620,000; Add Pay $1,620,000; Deduct Pay $1,710,000; #7 Collect $1,620,000; Add Collect $1,710,000; Deduct Collect $1,530,000

6A Carpentry, Value $1,080,000; #7 Pay $972,000; Add Pay $972,000; Deduct Pay $1,026,000; #7 Collect $972,000; Add Collect $1,026,000; Deduct Collect $918,000

7A Hollow Metal, Value $360,000; #7 Pay $324,000; Add Pay $324,000; Deduct Pay $342,000; #7 Collect $324,000; Add Collect $342,000; Deduct Collect $306,000

8A Doors, Windows, Glass, Value $900,000; #7 Pay $810,000; Add Pay $810,000; Deduct Pay $855,000; #7 Collect $810,000; Add Collect $855,000; Deduct Collect $765,000

9A Lath & Plaster, Value $900,000; #7 Pay $810,000; Add Pay $810,000; Deduct Pay $855,000; #7 Collect $810,000; Add Collect $855,000; Deduct Collect $765,000

10A Specialties, Value $540,000; #7 Pay $486,000; Add Pay $486,000; Deduct Pay $513,000; #7 Collect $486,000; Add Collect $513,000; Deduct Collect $459,000

11A Mechanical, Value $3,240,000; #7 Pay $2,916,000; Add Pay $2,916,000; Deduct Pay $3,078,000; #7 Collect 2,916,000; Add Collect $3,078,000; Deduct Collect $2,754,000

12A Electrical, Value $3,960,000; #7 Pay $3,564,000; Add Pay $3,564,000; Deduct Pay $3,762,000; #7 Collect $3,564,000; Add Collect $3,762,000; Deduct Collect $3,366,000

Course 26: Lakeside Amusement Park, Value $16,000,000

2A Excavation, Value $800,000; #7 Pay $720,000; Add Pay $720,000; Deduct Pay $760,000; #7 Collect $720,000; Add Collect $760,000; Deduct Collect $680,000

3A Concrete, Value $2,400,000; #7 Pay $2,160,000; Add Pay $2,160,000; Deduct Pay $2,280,000; #7 Collect $2,160,000; Add Collect $2,280,000; Deduct Collect $2,040,000

4A Masonry, Value $1,440,000; #7 Pay $1,296,000; Add Pay $1,296,000; Deduct Pay $1,368,000; #7 Collect $1,296,000; Add Collect $1,368,000; Deduct Collect $1,224,000

5A Steel & Miscellaneous, Value $1,600,000; #7 Pay $1,440,000; Add Pay $1,440,000; Deduct Pay $1,520,000; #7 Collect $1,440,000; Add Collect $1,520,000; Deduct Collect $1,360,000

6A Carpentry, Value $960,000; #7 Pay $864,000; Add Pay $864,000; Deduct Pay $912,000; #7 Collect $864,000; Add Collect $912,000; Deduct Collect $816,000

7A Metal, Value $320,000; #7 Pay $288,000; Add Pay $288,000; Deduct Pay $304,000; #7 Collect $288,000; Add Collect $304,000; Deduct Collect $272,000

8A Doors, Windows, Glass, Value $800,000; #7 Pay $720,000; Add Pay $720,000; Deduct Pay $760,000; #7 Collect $720,000; Add Collect $760,000; Deduct Collect $680,000

9A Lath & Plaster, Value $800,000; #7 Pay $720,000; Add Pay $720,000; Deduct Pay $760,000; #7 Collect $720,000; Add Collect $760,000; Deduct Collect $680,000

10A Specialties, Value $480,000; #7 Pay $432,000; Add Pay $432,000; Deduct Pay $456,000; #7 collect $432,000; Add Collect $456,000; Deduct Collect $408,000

11A Mechanical, Value $2,880,000; #7 Pay $2,592,000; Add Pay $2,592,000; Deduct Pay $2,736,000; #7 Collect $2,592,000; Add Collect $2,736,000; Deduct Collect $2,448,000

12A Electrical, Value $3,520,000; #7 Pay $3,168,000; Add Pay $3,168,000; Deduct Pay $3,344,000; #7 Collect $3,168,000; Add Collect $3,344,000; Deduct Collect $2,992,000

Course 28: 14 Story IZA Building, Value $14,000,000

2A Excavation, Value $700,000; #7 Pay $630,000; Add Pay $630,000; Deduct Pay $665,000; #7 Collect $630,000; Add Collect $665,000; Deduct Collect $595,000

3A Concrete, Value $2,100,000; #7 Pay $1,890,000; Add Pay $1,890,000; Deduct Pay $1,995,000; #7 Collect $1,890,000; Add Collect $1,995,000; Deduct Collect $1,785,000

4A Masonry, Value $1,260,000; #7 Pay $1,134,000; Add Pay $1,134,000; Deduct Pay $1,197,000; #7 Collect $1,134,000; Add Collect $1,197,000; Deduct Collect $1,071,000

5A Steel & Miscellaneous, Value $1,400,000; #7 Pay $1,260,000; Add Pay $1,260,000; Deduct Pay $1,330,000; #7 Collect $1,260,000; Add Collect $1,330,000; Deduct Collect $1,190,000

6A Carpentry, Value $840,000; #7 Pay $756,000; Add Pay $756,000; Deduct Pay $798,000; #7 Collect $756,000; Add Collect $798,000; Deduct Collect $714,000

7A Hollow Metal, Value $280,000; #7 Pay $252,000; Add Pay $252,000; Deduct Pay $266,000; #7 Collect $252,000 Add Collect $266,000; Deduct Collect $238,000

8A Doors, Windows, Glass, Value $700,000; #7 Pay $630,000; Add Pay $630,000; Deduct Pay $665,000; #7 Collect $630,000; Add Collect $665,000; Deduct Collect $595,000

9A Lath & Plaster, Value $700,000; #7 Pay $630,000; Add Pay $630,000; Deduct Pay $665,000; #7 Collect $630,000; Add Collect $665,000; Deduct Collect $595,000

10A Specialties, Value $420,000; #7 Pay $378,000; Add Pay $378,000; Deduct Pay $399,000; #7 Collect $378,000; Add Collect $399,000; Deduct Collect $357,000

11A Mechanical, Value $2,520,000; #7 Pay $2,268,000; Add Pay $2,268,000; Deduct Pay $2,394,000; #7 Collect $2,268,000; Add Collect $2,394,000; Deduct Collect $2,142,000

12A Electrical, Value $3,080,000; #7 Pay $2,772,000; Add Pay $2,772,000; Deduct Pay $2,926,000; #7 Collect $2,772,000; Add Collect $2,926,000; Deduct Collect $2,618,000

Course 30: Nesmrik County Jail, Value $12,000,000

2A Excavation, Value $600,000; #7 Pay $540,000; Add Pay $540,000; Deduct Pay $570,000; #7 Collect $540,000; Add Collect $570,000; Deduct Collect $510,000

3A Concrete, Value $1,800,000; #7 Pay $1,620,000; Add Pay $1,620,000; Deduct Pay $1,710,000; #7 Collect $1,620,000; Add Collect $1,710,000; Deduct Collect $1,530,000

4A Masonry, Value $1,080,000; #7 Pay $972,000; Add Pay $972,000; Deduct Pay $1,026,000; #7 Collect $972,000; Add Collect $1,026,000; Deduct Collect $918,000

5A Steel & Miscellaneous, Value $1,200,000; #7 Pay $1,080,000; Add Pay $1,080,000; Deduct Pay $1,140,000; #7 Collect $1,080,000; Add Collect $1,140,000; Deduct Collect $1,020,000

6A Carpentry, Value $720,000; #7 Pay $648,000; Add Pay $648,000; Deduct Pay $684,000; #7 Collect $648,000; Add Collect $684,000; Deduct Collect $612,000

7A Hollow Metal, Value $240,000; #7 Pay $216,000; Add Pay $216,000; Deduct Pay $228,000; #7 Collect $216,000; Add Collect $228,000; Deduct Collect $204,000

8A Doors, Windows, Glass, Value $600,000; #7 Pay $540,000; Add Pay $540,000; Deduct Pay $570,000; #7 Collect $540,000; Add Collect $570,000; Deduct Collect $510,000

9A Lath & Plaster, Value $600,000; #7 Pay $540,000; Add Pay $540,000; Deduct Pay $570,000; #7 Collect $540,000; Add Collect $570,000; Deduct Collect $510,000

10A Specialties, Value $360,000; #7 Pay $324,000; Add Pay $324,000; Deduct Pay $342,000; #7 Collect $324,000; Add Collect $342,000; Deduct Collect $306,000

11A Mechanical, Value $2,160,000; #7 Pay $1,944,000; Add Pay $1,944,000; Deduct Pay $2,052,000; #7 Collect $1,944,000; Add Collect $2,052,000; Deduct Collect $1,836,000

12A Electrical, Value $2,640,000; #7 Pay $2,376,000; Add Pay $2,376,000; Deduct Pay $2,508,000; #7 Collect $2,376,000; Add Collect $2,508,000; Deduct Collect $2,244,000

Course 32: Automotive Assembly Plant, Value $8,000,000

2A Excavation, Value $400,000; #7 Pay $360,000; Add Pay $360,000; Deduct Pay $380,000; #7 Collect $360,000; Add Collect $380,000; Deduct Collect $340,000

3A Concrete, Value $1,200,000; #7 Pay $1,080,000; Add Pay $1,080,000; Deduct Pay $1,140,000; #7 Collect $1,080,000; Add Collect $1,140,000; Deduct Collect $1,020,000

4A Masonry, Value $720,000; #7 Pay $648,000; Add Pay $648,000; Deduct Pay $684,000; #7 Collect $648,000; Add Collect $684,000; Deduct Collect $612,000

5A Steel & Miscellaneous, Value $800,000; #7 Pay $720,000; Add Pay $720,000; Deduct Pay $760,000; #7 Collect $720,000; Add Collect $760,000; Deduct Collect $680,000

6A Carpentry, Value $480,000; #7 Pay $432,000; Add Pay $432,000; Deduct Pay $456,000; #7 Collect $432,000; Add Collect $456,000; Deduct Collect $408,000

7A Hollow Metal, Value $160,000; #7 Pay $144,000; Add Pay $144,000; Deduct Pay $152,000; #7 Collect $144,000; Add Collect $152,000; Deduct Collect $136,000

8A Doors, Windows, Glass, Value $400,000; #7 Pay $360,000; Add Pay $360,000; Deduct Pay $380,000; #7 Collect $360,000; Add Collect $380,000; Deduct Collect $340,000

9A Lath & Plaster, Value $400,000; #7 Pay $360,000; Add Pay $360,000; Deduct Pay $380,000; #7 Collect $360,000; Add Collect $380,000; Deduct Collect $340,000

10A Specialties, Value $240,000; #7 Pay $216,000; Add Pay $216,000; Deduct Pay $228,000; #7 Collect $216,000; Add Collect $228,000; Deduct Collect $204,000

11A Mechanical, Value $1,440,000; #7 Pay $1,296,000; Add Pay $1,296,000; Deduct Pay $1,368,000; #7 Collect $1,296,000; Add Collect $1,368,000; Deduct Collect $1,224,000

12A Electrical, Value $1,760,000; #7 Pay $1,584,000; Add Pay $1,584,000; Deduct Pay $1,672,000; #7 Collect $1,584,000; Add Collect $1,672,000; Deduct Collect $1,496,000

Course 34: 10 Story Apartment Building, Value $8,000,000

2A Excavation, Value $400,000; #7 Pay $360,000; Add Pay $360,000; Deduct Pay $380,000; #7 Collect $360,000; Add Collect $380,000; Deduct Collect $340,000

3A Concrete, Value $1,200,000; #7 Pay $1,080,000; Add Pay $1,080,000; Deduct Pay $1,140,000; #7 Collect $1,080,000; Add Collect $1,140,000; Deduct Collect $1,020,000

4A Masonry, Value $720,000; #7 Pay $648,000; Add Pay $648,000; Deduct Pay $684,000; #7 Collect $648,000; Add Collect $684,000; Deduct Collect $612,000

5A Steel & Miscellaneous, Value $800,000; #7 Pay $720,000; Add Pay $720,000; Deduct Pay $760,000; #7 Collect $720,000; Add Collect $760,000; Deduct Collect $680,000

6A Carpentry, Value $480,000; #7 Pay $432,000; Add Pay $432,000; Deduct Pay $456,000; #7 Collect $432,000; Add Collect $456,000; Deduct Collect $408,000

7A Hollow Metal, Value $160,000; #7 Pay $144,000; Add Pay $144,000; Deduct Pay $152,000; #7 Collect $144,000; Add Collect $152,000; Deduct Collect $136,000

8A Doors, Windows, Glass, Value $400,000; #7 Pay $360,000; Add Pay $360,000; Deduct Pay $380,000; #7 Collect $360,000; Add Collect $380,000; Deduct Collect $340,000

9A Lath & Plaster, Value $400,000; #7 Pay $360,000; Add Pay $360,000; Deduct Pay $380,000; #7 Collect $360,000; Add Collect $380,000; Deduct Collect $340,000

10A Specialties, Value $240,000; #7 Pay $216,000; Add Pay $216,000; Deduct Pay $228,000; #7 Collect $216,000; Add Collect $228,000; Deduct Collect $204,000

11A Mechanical, Value $1,440,000; #7 Pay $1,296,000; Add Pay $1,296,000; Deduct Pay $1,368,000; #7 Collect $1,296,000; Add Collect $1,368,000; Deduct Collect $1,224,000

12A Electrical, Value $1,760,000; #7 Pay $1,584,000; Add Pay $1,584,000; Deduct Pay $1,672,000; #7 Collect $1,584,000; Add Collect $1,672,000; Deduct Collect $1,496,000

Figure 3:
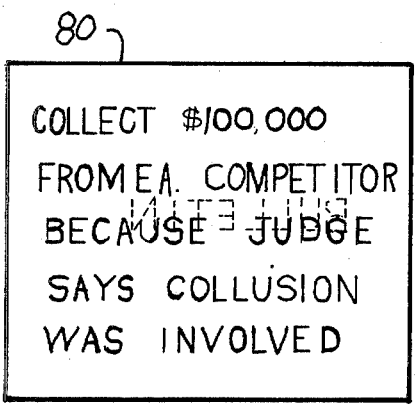
FIG. 3 is a plan view of one of a plurality of so-called "bulletin" cards which are to be drawn from individually by each participant during selected portions of the game.
Figure 4:
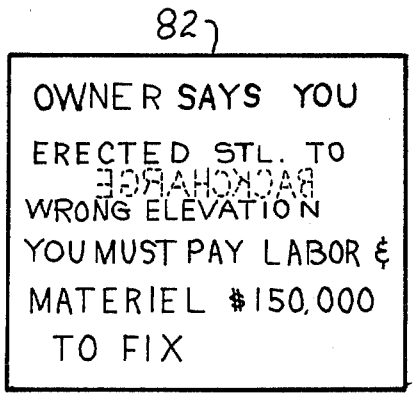
FIG. 4 is a plan view of one of a plurality of so-called "backcharge" cards which are to be drawn from individually by each participant during selected portions of the game.

As can best be seen in FIG. 3, the game includes a plurality of so-called "bulletin" cards 80 which the participants utilize throughout portions of the game and which provide the participants with various penalties and/or rewards. The instructions set forth in each of the fifteen "bulletin" cards 80 are as follows:

1. Architectural problem nets you $50,000 for your solutions—collect from owner
2. Owner grants you an additional $10,000 for job completed way ahead of schedule
3. Air pollution equipment owner had to buy from you costs him $80,000—collect $80,000
4. State Fire Marshall tells owner building is not safe—collect $150,000 for additional work you performed to make it safe (from owner)
5. Litigation paid off—collect $40,000 for job extra
6. You have just made $50,000 on the new addition for this job—collect $50,000
7. Collect $100,000 from owner as result of insurance settlement
8. Collect $100,000 from each competitor because judge says collusion was involved
9. Cost saver you proposed earlier nets you $20,000
10. The owner has agreed to pay you $100,000 for your repair of the wall that fell down from wind damage
11. Owner pays you additional $25,000 for engineering services on this building and future adaptations
12. For extra to contract, collect $25,000 from owner
13. Owner wants to pay your invoice you forgot to send—collect $28,000 from him
14. OSHA demands gain you $350,000 for additional work you performed—collect from owner
15. Owner has agreed to pay you $500,000 for new addition As can be seen in FIG. 4, the game includes a plurality of so-called "backcharge" cards 82 totaling fifteen cards and which include the following instructions which the participants must follow in the manner described hereinafter:

1. Owner says your engineering goof cost him $300,000—pay him
2. Architect tells owner you should have known better—pay owner $200,000 to settle
3. Owner says you failed to meet schedule—you are penalized $100.00 per day—you're 120 days late—pay him $12,000
4. Owner says reason wall fell down is because you used low grade mud instead of mortar—pay him $75,000
5. Owner says you erected steel to wrong elevation—you must pay labor and material $150,000 to fix
6. Your non-compliance to local codes cost you $100,000—pay to owner 7. Labor strikes really do cost money for material and scheduling—pay owner $50,000 and labor and material $50,000

8. You started to erect something with Iron Workers instead of Electricians (Tsk! Tsk!)—goof costs you $45,000 (payable to labor and material)

9. Owner says your labor and material were not to specification—forfeit retainage 10. Material you failed to provide, but was in your contract, costs you $50,000, payable to owner 11. Tsk! Tsk! You were involved in collusion—judge says pay each competitor $100,000

12. Owner caught you substituting cheaper material—pay him $50,000

Figure 8:
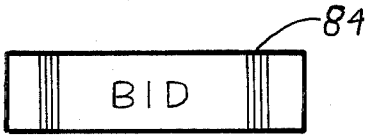
FIG. 8 is a front plan view of a so-called "bid" card utilized during the course of the game to provide the participants with a means for selecting which course will be played.
Figure 9:
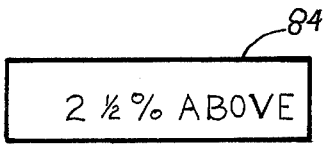
FIG. 9 is a rear plan view of the "bid" card illustrated in FIG. 8.

13. You forgot to tell owner you quoted job delivered only—goof costs you $500,000 to labor and material 14. Electrical fire due to improper wiring—costs you $150,000, payable to labor and material 15. Sub-contractor does not provide item you thought he would—it cost you $350,000, payable to labor and material As can best be seen in FIGS. 8 and 9, each player is provided with one set of color-coated bid cards 84. The bid cards 84 include specific information which permits the participants to bid on the various construction jobs. As shown in FIG. 8 of the drawings, the face of the bid cards 84 are color-coated so each participant knows which card is his, all of which becomes more clear during the description of the manner in which the game is played. The back side of each bid card includes certain designated information. Each player will have six bid cards. Each bid card 84 has on its back side one of the following notations: 5% below; 2.5% below, 10% above, 5% above, 2.5% above and cost. These six notations correspond to the bidding amount in space 66 in each of the courses 12 through 34, and the manner in which they are used will be described hereinafter.

Figure 6:
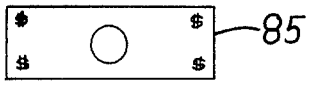
FIG. 6 is a plan view of script money used in various denominations.
Figure 7:
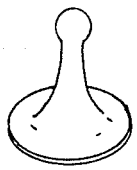
FIG. 7 is one example of a playing piece employed in playing the game.
Figure 7A:
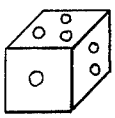
FIG. 7*a* is a perspective view of a dice.

FIG. 6 is illustrative of the script currency 85 which is utilized during the game, and in the preferred embodiment currency ranging from $1,000 bills to $1,000,000 bills are utilized. Each player would receive ten $1,000 bills; five $5,000 bills; five $10,000; five $20,000 bills; five $50,000 bills; five $100,000 bills; two $500,000 bills; and two $1,000,000 bills. FIG. 7 illustrates a typical game piece 86.

In use the game is set up so that the bulletin cards 80 and the backcharge cards 82 are positioned face down, in two stacks 88 and 90, on the board 10 as shown. In the preferred embodiment four players utilize the game, and each player receives the color-coated set of bid cards 84, each of which includes the aforementioned number of cards having the designations set forth above. Each player is also distributed the aforementioned amount of script currency 85. Any player, or players, may function as both the banker and owner and, in addition to playing, functions in this capacity to take money and give money to each player during the course of the game in the manner to be described.

To commence the game, the players bid on the smallest construction job, which in the present example is either the Course 16 or 18, each having an approximate cost of $4,000,000. Each player bids on the job by secretly selecting one of the bid cards 84 and placing the same, face down, on the bid space 38. After each player has bid, the players all place their bid cards 84 face up, and the lowest bid plays that particular course. The low bids result in the rejection of all bids, and the job is rebid immediately until one of the participants has a low bid. The remaining participants, as well as the first participant who has a low bid, continue to bid on the other courses until each participant has a construction course to play. It is generally recommended that a player not play two jobs at the same time; however, a player is not limited to playing only one job. Playing two jobs at one time may result in the bankruptcy of a player and his withdrawal from and loss of the game.

When each of the participants has a construction job, the game commences with the theoretical construction of the particular project. This is accomplished by first moving a playing piece or token 86 to the starting position 40. Each participant rolls the dice 92 to determine who is to start first, with the highest roll being the participant who moves first. That participant moves to the first stage of construction, that is, the excavation space 42. Each player then rolls the dice to determine his cost for constructing and the payment he receives from the owner. During the roll of the dice 92 if the numbers 2, 6, 8 or 11 turn up, the numbers refer to the "deduct" portion of the card 70, while the numbers 3, 4, 5, 9, 10 and 12 refer to the "add" portion, as shown on the reverse side of the instruction cards 70. The number 7 is an even position.

For example, in the construction of the State Parking Deck, as illustrated in FIG. 2 of the drawings, if a participant rolls a 4 on the $200,000 excavation sub-contract job and since 4 is a "add" number, a reference to the reverse side of card 70 shows that the "add" results in, theoretically, the participant having to pay $180,000 for labor materials in order to achieve or to have the land excavated. Since 4 represents "add," the player collects $190,000 from the owner. Therefore, the player has earned $10,000 for this phase of the game.

Alternately, if the dice roll had been an 8, the participant would have rolled a "deduct." In this situation he would have paid for labor materials $190,000 and would have only collected $170,000 from the owner. This would have been a loss of $20,000 for this portion of the game. The participant who functions as both the owner and banker receives the money from the other participants, as well as money from himself to pay for labor materials, and disburses money from the owner so that each player ends up with a net profit or loss for each particular stage of the game, as aformentioned.

After a participant has played the first section of the game, the next player plays his turn and follows the same procedures. When a player has moved to the next phase, which will be space 44, the concrete phase, the play continues in the same manner as aforementioned. When each player completes his last phase, that is, phase 12A, he moves into the collect retainage box. Prior to moving to the retainage box, he rolls for a bulletin card 80 or a backcharge card 82. An even dice roll, that is, 2, 4, 6, 8, 10 or 12, results in picking a bulletin card 80, while an odd dice roll 3, 5, 7, 9 or 11 results in picking a backcharge card 82. The player draws the selected card and follows instructions given thereon, as aforementioned. The card is then placed to the bottom of the deck drawn from. After following the instructions set forth in the bulletin or backcharge card, the participants complete their last portion of the course by collecting from the owner the retainage corresponding to the amount bid. For example, in the State Park Deck, if the bid was 2.5% below cost, the retainage is $390,000; and this amount would be paid to the participant.

Each of the participants now bids on a new job different from the one completed, and each participant continues to do this until all the jobs have been played or until some time limit, which was previously set by the players, has expired. Any person who cannot at any time pay for his labor and material cost goes into bankruptcy and looses the game. At the end of the game when all the jobs are completed, each player counts up his money, and the player with the most money wins the game.

In order to insure that the game board has a long life, it should be coated with a plastic material, or at a minimum the spaces 40 through 62 which are used to a greater degree should be so coated.

It can thus be seen that the present invention has provided a new and improved game which will provide great stimulus to the participants and provide them with knowledge of the financial and business aspects of the construction business.

While only one form of the present invention has been disclosed, it should be understood by those skilled in the field of such educational games that other forms may be had, all coming within the spirit of the invention and the scope of the appended claims.

What is claimed is as follows:

1. A game for a plurality of players, said game comprising:

a game board having a plurality of adjacent individual sections, each section comprising a self-contained playing course wherein no playing course extends into any adjacent section, only one of each of said players playing a playing course at one time;

a plurality of bid cards which each player selectively uses to bid so as to play one of said courses;

a plurality of game tokens, one for each player;

a plurality of sub-steps associated with each self-contained course and through which one token is moved, each of said substeps having indicia thereon distinct from the indicia on any other said substep, said one token being moved sequentially through each sub-step;

a plurality of instruction cards, each having indicia thereon, the indicia on each of said substeps corresponding to the indicia on one of said instruction cards, each card having a plurality of instructions which determine, by chance, the player's reward or penalty at each sub-step of said associated playing course; and a plurality of chance cards providing selected rewards and/or penalties in addition to said instruction cards, at least one such card being drawn by a player during the play on each playing course.

2. The game of claim 1 wherein each self-contained playing course represents a specific construction project and the sub-steps associated with that course represent specific job components of the construction project.

3. The game of claim 2 wherein each playing course construction project has an estimated cost of completion associated therewith and wherein the players selectively and secretively bid so as to play that playing course, by committing to achieve completion of the project at a specific cost, by means of the bid cards which contain single bids above, below and equal to the estimated cost for completion of the project, the lowest bidder achieving the opportunity to play the course.

4. The game of claim 2 wherein each job sub-step sets forth an estimated cost of achievement and wherein the instruction card associated with each such sub-step directs the determination, based on the roll of dice, of amounts paid out and collected by the player at that job sub-step, thus providing for realization by the player of profit or loss at that sub-step.

5. The game of claim 4 which further comprises play script currency which is distributed to the players in predetermined amounts at the outset of the game, wherein the players bid to play project courses until each player has at least one course to play;

wherein the players take alternate turns to play their project courses, realizing profits and losses in play scirpt in accordance with the instruction cards;

wherein on completion of the projects played, the bidding and play are repeated for the remaining, unplayed projects; and wherein any player who retains insufficient play script to pay out as directed on an instruction card goes into bankruptcy and loses the game and the player who accumulates the most play script during the play wins the game.

* * * * *